US006366733B1

(12) United States Patent
Reiker

(10) Patent No.: US 6,366,733 B1
(45) Date of Patent: Apr. 2, 2002

(54) CEILING FAN HAVING ONE OR MORE FAN HEATERS

(76) Inventor: Kenneth H. Reiker, 269 Country Club dr., Shalimar, FL (US) 32579

( * ) Notice: Subject to any disclaimer, the term of this patent is extended or adjusted under 35 U.S.C. 154(b) by 0 days.

(21) Appl. No.: 09/598,855

(22) Filed: Jun. 21, 2000

Related U.S. Application Data

(60) Provisional application No. 60/141,499, filed on Jun. 28, 1999.

(51) Int. Cl.[7] ..... F24H 3/00
(52) U.S. Cl. ..... 392/364; 416/5
(58) Field of Search ..... 392/360–369, 392/384, 385; 416/5, 95; 165/122, 125

(56) References Cited

U.S. PATENT DOCUMENTS

| | | | | | |
|---|---|---|---|---|---|
| 449,404 | A | | 3/1891 | Dewey | |
| 2,359,021 | A | | 9/1944 | Campbell et al. | |
| 2,504,798 | A | * | 4/1950 | Brinen | 392/364 |
| 3,223,828 | A | | 12/1965 | Mast | |
| 3,458,739 | A | | 7/1969 | Zelinski et al. | 310/62 |
| 3,612,168 | A | | 10/1971 | Peterson | 165/86 |
| 4,508,958 | A | | 4/1985 | Kan et al. | |
| 4,694,142 | A | | 9/1987 | Glucksman | |
| 4,782,213 | A | | 11/1988 | Teal | |
| D320,439 | S | | 10/1991 | Harper | D23/328 |
| 5,077,825 | A | | 12/1991 | Monrose | 392/361 |
| D327,315 | S | | 6/1992 | Pelonis | D23/355 |
| 5,133,042 | A | | 7/1992 | Pelonis | 392/365 |
| 5,259,062 | A | | 11/1993 | Pelonis | 392/365 |
| 5,333,235 | A | | 7/1994 | Ryder | 392/364 |
| D358,873 | S | | 5/1995 | Pelonis | D23/337 |
| 5,425,126 | A | | 6/1995 | Lee | 392/364 |
| 5,489,191 | A | | 2/1996 | Tai | |
| D381,074 | S | | 7/1997 | Pelonis | D23/336 |
| 5,668,920 | A | | 9/1997 | Pelonis | 392/361 |
| D404,123 | S | | 1/1999 | Pelonis | D23/336 |
| 5,887,785 | A | | 3/1999 | Yilmaz | 237/1 R |
| D423,661 | S | | 4/2000 | Pelonis | D23/395 |
| 6,160,956 | A | | 12/2000 | Pelonis | 392/361 |
| 6,240,247 | B1 | * | 5/2001 | Reiker | 392/364 |
| 6,244,820 | B1 | | 6/2001 | Yilmaz | |

FOREIGN PATENT DOCUMENTS

| | | | |
|---|---|---|---|
| DE | 3814612 | | 11/1989 |
| GB | 865167 | * | 4/1961 |
| JP | 1-123949 | | 5/1989 |
| WO | WO 01/01047 | | 1/2001 |

OTHER PUBLICATIONS

"The Fan Book", published by Reston Publishing Company, pp. 3–128, Copyright 1983.
Internet Web Page entitled "Pelonis U.S.A.", Pelonis USA, Ltd., 2000, 7 pages.

* cited by examiner

*Primary Examiner*—John A. Jeffery
(74) *Attorney, Agent, or Firm*—Joel D. Myers; Myers & Associates, P.C.

(57) ABSTRACT

Each of one or more ducts disposed proximate an electric ceiling fan motor within a housing includes one or more heating elements. One or more motors driving one or more fans is mounted in each duct to draw air through an inlet, heat the inflowing air, and exhaust the heated air through an outlet. Each duct may be thermally insulated from the ceiling fan motor and/or the housing to prevent overheating of the latter during operation. The upwardly moving air from the ceiling fan mixes with the heated air exhausted from each outlet. As a result of the air movement within the room caused by the ceiling fan, the heated air will be uniformly dispersed and the room will be uniformly heated.

92 Claims, 4 Drawing Sheets

CEILING FAN HAVING ONE OR MORE FAN HEATERS

CROSS REFERENCE TO RELATED APPLICATIONS

The present application discloses information common with and claims priority to a provisional application entitled "CEILING FAN HAVING DUAL FAN HEATERS" filed Jun. 28, 1999 and assigned Ser. No. 60/141,499, which application describes an invention made by the present inventor.

BACKGROUND OF THE INVENTION

1. Field of the Invention

The present invention relates to room conditioners and, more particularly, to heaters embodied with a ceiling fan for injecting heated air into the airflow generated by the ceiling fan to uniformly maintain a room at a constant comfortable temperature.

2. Description of Related Art

In present forced air heating systems, whether in an office environment or in a residence, a heating element is energized by burning gas, burning coal or electricity. A blower is employed for blowing air across the heating element to force the heated air into a duct system. Entry of the heated air into the duct system generally requires a change in direction of the blown heated air, which change of direction creates resistance to airflow. To channel the heated air through multiple changes in direction within the duct system until it is finally exhausted into respective rooms creates further resistance to the airflow. Registers having louvers, whether fixed or movable, generally cover the duct system outlets in each room. Such louvers further alter the direction of airflow and create resistance to the airflow. The collective sum; of resistances to airflow presented by a conventional forced air system requires a blower of significant power to ultimately provide a reasonable and acceptable flow of air into each room through a louvered outlet.

The louvered outlets may be close to the floor, close to the ceiling or anywhere in between depending upon various construction requirements and other impediments. The outflow of heated air through an outlet close to the floor will create adjacent hot spots for an occupant that renders seating close to the louvered outlet uncomfortable. Heated airflow through a louvered outlet close to the ceiling tends to restrict disbursement of the heated air throughout the room as heated air rises and tends to remain in proximity with the ceiling; thus, there may exist cold spots in parts of the room close to the floor. Finally, certain parts of a room may be subjected to a downward blast of hot air that is uncomfortable and limits furniture arrangement to prevent a person from being subjected to such a blast.

Conventional duct work is generally of galvanized sheet material which is an excellent thermal conductor. The duct work will therefore tend to become heated and radiate heat into the adjacent attic or walls. Such radiated heat is lost to the occupants of a residence or office and the heater must have an output of sufficient BTU's (British thermal units) to compensate for these heat losses and yet provide sufficient heat to the rooms of interest.

The change in temperature of the duct work may result in condensation developing on the surface of the duct work and adjacent the louvers at the outlets. Such condensation may flow and seep into the material of the walls of a room or office and cause discoloration.

If certain rooms or offices are unoccupied, it is bothersome to prevent the heating thereof as the respective louvers must be closed and thereafter reopened. Such closing and reopening is generally considered too bothersome to be done unless the respective room(s) is to be closed for a significant period of time. Thus, rooms which are not occupied will remain, heated to the detriment of unnecessary energy usage and expense.

It therefore becomes evident that presently widely used forced air heating systems require large capacity heaters to overcome the thermal losses incurred during delivery of the heated air to each room. Large capacity blowers are required to overcome the flow restrictions presented by the duct system and outlet louvers. The energy consumption resulting from such heaters and blowers without any benefit to the occupants of a residence or office is significant and expensive. Blasts of hot air and poor mixing of the heated air with the ambient air in the space to be heated creates discomfort to the occupants.

SUMMARY OF THE INVENTION

The present invention is directed to a room conditioner for heating and gently recirculating air in a room to maintain the air throughout the room at a pleasant uniform temperature without drafts or blasts of heated air. The room conditioner includes a pair of ducts located on opposed sides within a housing attendant a ceiling fan. Each duct includes an outlet at each end essentially coincident of the wall of the housing. An electric motor is centrally mounted within each passageway and includes a rotating shaft extending in opposed directions for supporting a fan at each end. The duct proximate the motor includes a plurality of inlets to accommodate an inflow of air drawn by each fan. Downstream of each fan within the duct is an electric heating element for heating the air flowing therepast as a result of rotation of the adjacent fan. Alternatively, only one, instead of a pair of ducts may be used. Such single duct may include one or more electronic motors operating one or more fans forcing air past one or more electronic heating elements to exhaust heated air through one or more outlets. In operation, the heated air exhausting from each outlet is mixed with the air flow created by the ceiling fan and the mixture of air is uniformly dispersed throughout the room wherein the room conditioner is mounted. The resulting warmed air circulates gently throughout the room to warm the room to a temperature comfortable for a user. All of the heat produced by the heating element(s) is essentially conveyed throughout the room at significant energy cost savings compared to a forced air heating system. When the room is not being used, the ceiling fan and heating element(s) may be turned off to conserve on electrical energy resulting in an attendant cost savings.

It is therefore a primary object of the present invention to provide a room conditioner for efficiently heating and maintaining a room at a temperature comfortable to a user.

Another object of the present invention is to provide energy efficient apparatus for selectively heating a room being used.

Still another object of the present invention is to provide a room conditioner producing high volume low velocity heated air circulating throughout a room.

Yet another object of the present invention is provide a room conditioner embodying a ceiling fan and at least one associated air heating units, which heating units will not increase the operating temperature of the ceiling fan motor.

A further object of the present invention is to provide a room conditioner embodying a motor for rotating the set of blades of a ceiling fan and at least one secondary fan for forcing air past at least one heating element to mix the heated air with the surrounding airflow produced by the set of blades of the ceiling fan.

A still further object of the present invention is to provide a room conditioner capable of introducing a flow of heated air from a heater and for cooling a room when the heater is not energized.

A yet further object of the present invention is to provide a method for uniformly and efficiently heating a room.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figures 1, 1A:
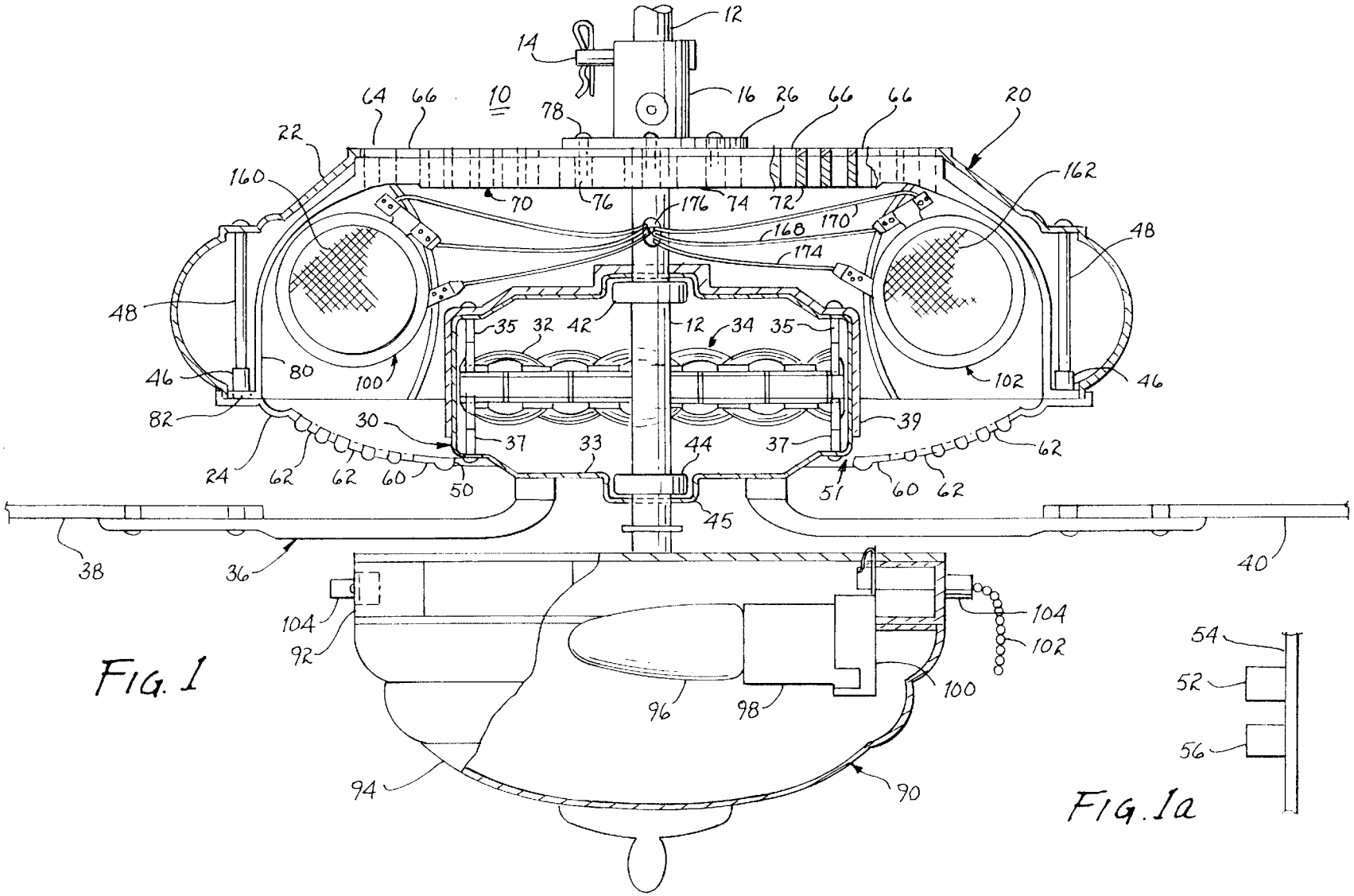
FIG. 1 is a partial representative cross-sectional view of a room conditioner suspended from a ceiling.
FIG. 1*a* is a representative view of wall mounted controls.

Referring to FIG. 1, there is illustrated in partial cross-section a room conditioner 10 which may be suspended below a ceiling. The room conditioner includes a depending shaft 12 depending from a mounting secured to a ceiling mounted brace. A pin 14 secures a fixture 16 to the shaft. A housing 20, including an upper part 22 and lower part 24, is attached to a plate 26 in engagement with fixture 16. Neither upper nor lower housings of housing 20 serves a support function for any components; hence, the material of the housing may be dictated primarily by decorative considerations and may be made of metal, plastic, glass or components of the housing may have elements of these materials. Moreover, the material of housing 20 may be thermally insulative to permit heat sensitive decorative elements to be mounted thereon or formed as part thereof. Furthermore, housing 20 may be of electrically insulating material for safety reasons. A casing 30 is rotatably mounted upon shaft 12 and is secured to rotor 32 of electric motor 34. The stator (not shown) of the electric motor is fixedly attached to shaft 12. A set of fan blades 36, of which blades 38, 40 are shown, is fixedly attached to casing 30. Thereby, rotation of rotor 32 will result in rotation of the casing and consequent rotation of set of fan blades 36. A thermally insulating shroud 39 may extend across the top and sides of the casing to thermally insulate the casing and the motor.

Casing 30, enclosing motor 34, is journaled upon shaft 12 by bearings 42 and 44 whereby the casing is free to rotate about the shaft. Casing 30 includes an upper casing 31 and a lower casing 33 secured to one another by bolts 35 engaging threaded receivers 37. A plurality of apertures may be disposed in the upper and/or lower casing to assist in providing ventilation for motor 34 . If thermally insulative shroud 39 is omitted, all or part of casing 30 may be of thermally insulative material, including non-metallic and dielectric materials, to prevent migration of heat from the heating elements to be described to motor 34 and consequent damage to the motor. To further assist in cooling motor 34, vents may be disposed in the top, bottom and/or cylindrical segment of casing 30 and/or forced air cooling of the motor may be accomplished by incorporating scoops at the bottom of the casing to capture air as the casing rotates and direct the captured air into the casing. Similar but reverse oriented scoops may be disposed in the top and/or sides of the casing to encourage outflowing of the air. Thereby, a positive airflow through the casing for purposes of cooling the motor can be accomplished whenever the casing rotates as a result of energization of the motor.

Lower housing 24 may include a plurality of threaded studs 46 for threadedly receiving bolts 48 extending downwardly from upper housing 22. Through such threaded engagement, a means is provided for securing the upper and lower housings to one another. Set of blades 36 is attached to casing 30 in the conventional manner. The bottom surface of lower housing 24 may include an aperture 50 to permit protrusion of all or part of casing 30. Such aperture may be of sufficient diameter to provide an annular space 51 between the perimeter of aperture 50 and casing 30 to permit a ready flow of air into the housing and to provide a ready source of air to be drawn into and through the heating elements to be described. Alternatively, either or both the upper and lower housings may include apertures in the top, bottom and/or sidewalls thereof to provide sufficient airflow into and out of the housing.

By having set of blades 36 rotate in a direction to direct air upwardly, the upwardly flowing air will mix with the warmed air exhausted from the upper part of housing 20. The mixing of the ambient temperature airflow with the heated airflow will produce a resulting airflow throughout the room that is at a higher temperature than the initial ambient temperature. A thermostat 52 may be mounted on wall 54 (see FIG. 1A) and electrically connected (not shown) to the heating elements internal of housing 20 to permit the temperature to be regulated. A remote control thermostat (not shown) may be used. A switch (not shown), whether or not a thermostat is used, may be employed to control operation of any heater used. Moreover, a switch 56, which may be wall mounted as shown, or as part of the ceiling fan and electrically connected (not shown) to motor 34 can permit control of the speed and direction of rotation of the motor and hence set of blades 36. Thus, operation of the heating elements and ceiling fan may be controlled and regulated to maintain the air within the room at a temperature preferred by an occupant of the room. A time delay may also be incorporated in or as part of switch 56 to first shut off the heating elements and then the motor and for other purposes. Furthermore, upon departure from the room, whether for a short period of time or an extended absence, room conditioner 10 may be shut down by switch 56 to conserve on the use of electric power.

To enhance airflow into the interior of housing 20, lower annular surface 60 may include a plurality of apertures 62, whether circular, elongated or other shape. The upper housing may includes a circular section 64 having a plurality of apertures 66 extending therethrough for purposes of ventilation. Means, such as plate 26, is secured to fixture 16 and retains section 64 to support housing 20.

Structural rigidity for the room conditioner is provided by internal shroud 70. The shroud, or parts thereof or a covering, may be of thermally insulative material to prevent damaging heat radiation to the surrounding housing.

Thereby, the material of the housing may be of any type of material dictated only by aesthetic considerations. Shroud 70 includes a structural platform 72 of generally planar circular configuration and may be commensurate with circular section 64. It may include a plurality of concentric arcs 204 in generally coincident relationship with apertures 66, which may also be arcs to provide for passage of air therethrough. A hub 74 includes a plurality of apertures 76 for penetrably receiving bolts 78 extending from plate 26 secured to fixture 16. Platform 72 may have significant thickness to provide the requisite strength and robustness to support the heating elements depending therefrom, as will be described below. Shroud 70 includes a circular skirt 80 extending radially and downwardly from platform 72 and terminates at a radial flange 82. Radial flange 82 engages the junction between upper and lower housings 22, 24 and may be secured thereto by bolts or screws (not shown). Circular skirt 80 may be thermally insulating or include thermal insulation to protect and shield housing 20 from radiant heat produced by any heating element or associated motor.

A light fixture 90, as shown in FIG. 1, may be attached to room conditioner 10. The light fixture includes a base 92 for attachment to shaft 12 extending downwardly from casing 30. The base supports a transparent or translucent bowl 94. A light 96 mounted within an appropriate socket 98 is secured by a support 100 to base 92. As depicted, a pull chain 102 operating a switch 104 may be used to control operation of light 96. Base 92 may also include a switch 104 for changing the direction of rotation of set of blades 36, as is common. Furthermore, one or more switches, whether pull chain switches or otherwise, may be secured in base 92 for operating the ceiling fan, as is well known. The electrical connections and routing of electrical conductors through the hollow core of shaft 12 will not be described as such connections and routing are well known.

Referring jointly to FIGS. I and 2, heating units 100 and 102 will be described in further detail. As these heating units are essentially duplicative of one another, components common to each will be given the same reference numerals and discussion thereof will pertain to each. Each heating unit 100, 102 includes a curved or angled duct 104 having opposed terminal outlets 106, 108 defined by opposed ends of the duct. It is to be noted that in some applications only one of heating units 100, 102 may be used. In other applications the type of heating unit shown in FIG. 4 may be used.

While there are many ways for mounting ducts 104, simple mounting mechanisms will be described. An angled brace 110 may be welded or otherwise secured to duct 104 proximate outlet 106. A bolt 112 extends through housing 20 and skirt 80 of shroud 70 for attachment to the brace by a nut 114. Brace 116 is attached to duct 104 proximate outlet 108. A bolt 118 extends through housing 20 and skirt 80 of shroud 70. The bolt may be secured by a nut 120. It may be noted that housing 20 is only partially shown in FIG. 2 for purposes of clarity. A brace 122 is attached to and extends from duct 104. The brace may be secured to skirt 80 by a bolt 124 extending through housing 20 and skirt 80 into engagement with the brace and secured in place by a nut 126. A brace 128 is attached to duct 104. The brace may be secured to skirt 80 by a bolt 130 extending through housing 20, skirt 80 and into engagement with the brace. It may be secured to the brace by a nut 132. It is to be noted that many other devices or attachment means may be employed to secure each of ducts 104 of heating units 100 and 102 to shroud 70.

An electric motor 140 is mounted within each of ducts 104 at their proximate internal center by means of a mounting 142. The mounting may be attached to motor 140 in a conventional manner well known to those skilled in the art. The mounting may be welded, braised, or otherwise attached to duct 104. As illustrated, bolts 144 may extend through the duct and mounting 142 and secured in place by nuts 146.

Motor 140 includes a rotatable shaft 150 extending in opposed directions for supporting fans 152, 154 at opposed ends. Upon rotation of shaft 150 resulting from energization of motor 140, the blades of fans 152, 154 urge a flow of air through outlets 106, 108, respectively. Each of ducts 104 includes a plurality of apertures or inlets 156 disposed in the general center area of the duct. Thus, air is drawn into each duct 104 through inlets 156 and exhausted through outlets 106, 108. Downstream of fan 152 is a heating element 160 mounted within duct 104. The heating element is a commercially available element and is secured in place within the duct by conventional attachment means. Similarly, a heating element 162 is mounted within each duct downstream of fan 154. Each of these heating elements is apertured or otherwise perforated to permit airflow therethrough with a resulting heating of such airflow by electrically energized heating coils or the like.

Variations of the heating units 100 and 102 are contemplated. Such variations include not only one duct instead of two, as set forth above, but also the use of an electric motor for each fan. A simple electric motor may rotate one fan that draws air in through one of outlets 106, 108 and exhausts the heated air through the other outlet. More than one heating element may be associated with each flow of air. And, any heating element may be located adjacent the respective outlet to minimize heat transfer by conduction or radiation into the housing.

As particularly shown in FIG. 1, electrical power to heating elements 160, 162 of heating unit 100 may be provided by conductors 164, 166, respectively. Similarly, electric power to heating elements 160, 162 of heating unit 102 may be provided electrical conductors 168, 170, respectively. Electrical power to motor 140 in heating unit 100 may be provided by electrical conductor 172. Similarly, electrical power to motor 140 of heating unit 102 may be provided by conductor 174. As shaft 12 is hollow, it may include an opening 176 for receiving conductors 164 to 174. These conductors extend through shaft 12, the ceiling and the walls to switch 56 and/or thermostat 52 (see FIG. 1A) to permit control of operation of both motors 140 and heating elements 160, 162.

Figure 2:
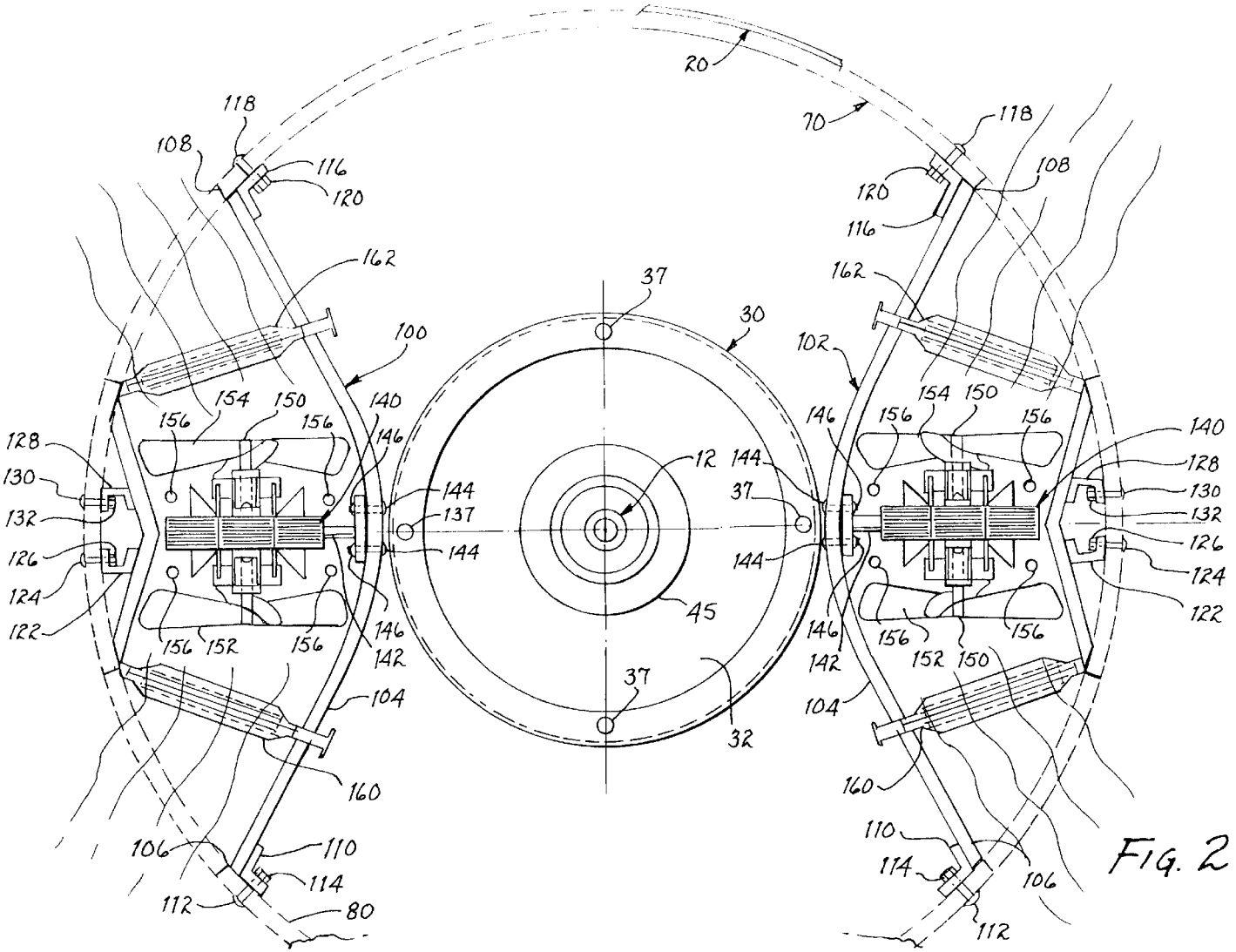
FIG. 2 is a partial cross-sectional view of the interior of the room conditioner shown in FIG. 1, which view looks upwardly into the room conditioner.

As shown in FIG. 2, casing 30 may be located centrally intermediate the lower part of heating units 100, 102 and shaft 12 extends centrally downwardly therefrom. A circular depression 45 is depicted in lower casing 32 to receive and support bearing 44 secured to shaft 12 (see also FIG. 1).

Figure 3:
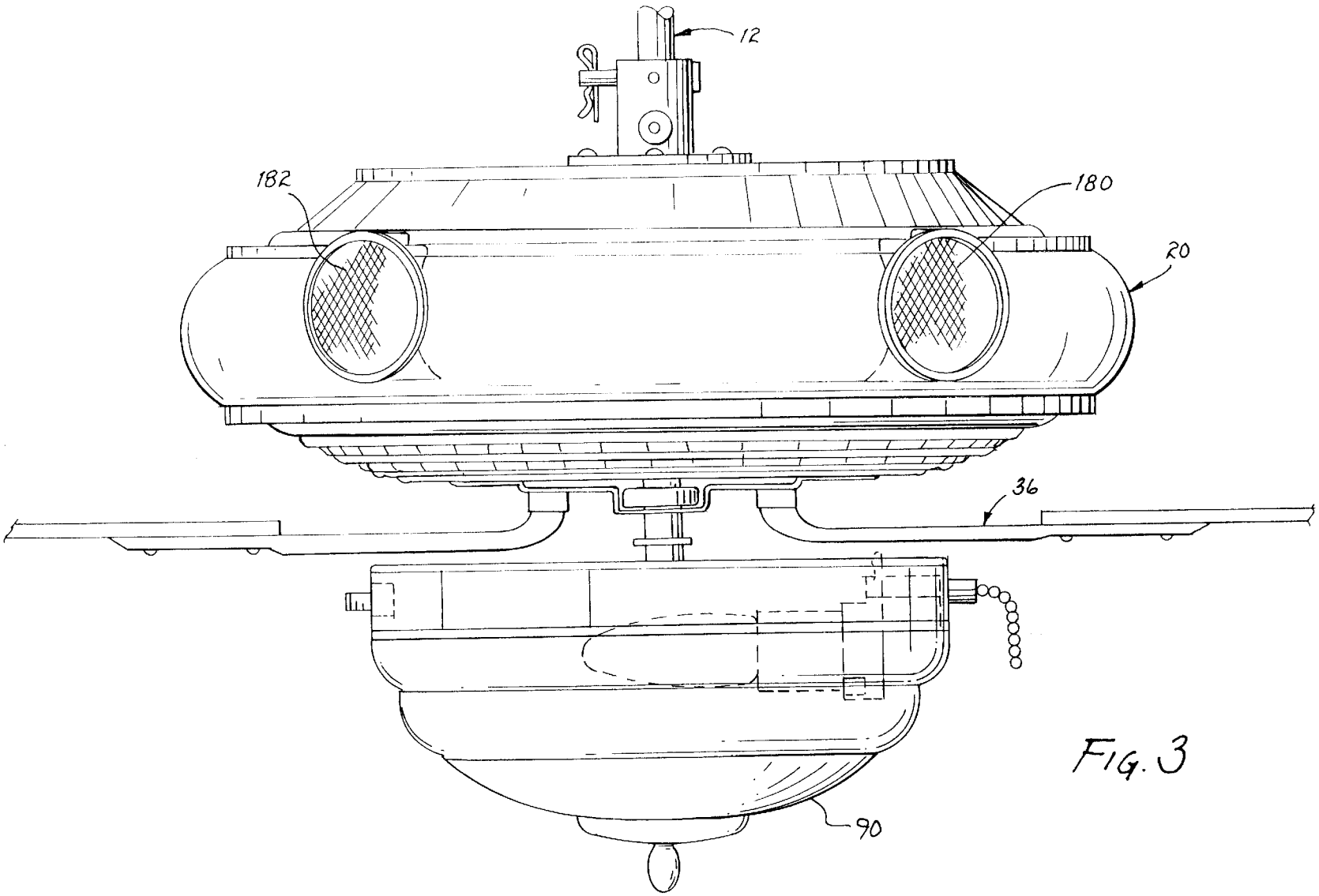
FIG. 3 is a side view of the room conditioner shown in FIG. 1 and illustrating the outlets for the heated air.

As particularly shown in FIG. 3, apertured covers 180, 182 are located coincident with outlets 106, 108 and secured by a snap fit or by a more permanent attachment to either or both of housing 20 and skirt 80 of shroud 70. As these covers are viewable by an occupant of the room, the covers should have a decorative effect compatible and commensurate with the type and nature of decoration of housing 20.

In operation, either or both of motors 140 may be energized to provide outflow of air through outlets 106, 108. Upon energizing the motors, heating elements 160, 162 may be energized to a greater or lesser extent, depending upon the amount of heat sought to be generated. The air flow resulting from rotation of fans 152, 154 will blow air through each of the heating elements to heat the air and the heated air will exhaust through outlets 106, 108 and through covers 180, 182. Simultaneously, set of fan blades 36 will be rotating as a result of energization of motor 34. The resulting airflow, preferably vertically upwardly, will mix with the heated airflow exhausting through the corresponding ones of covers 180, 182 that may be present and such mixture will be relatively uniform. The resulting upward flow of uniformly mixed heated air will strike the ceiling of the room and flow laterally omnidirectionally. Such omnidirectional flow will result in low velocity uniformly heated air permeating throughout the room. When the room is no longer being used, the ceiling fan may be shut off along with the heating units. Thus, no further energy will be consumed to heat or even circulate air within a room no longer being used. Upon subsequent use of the room, the room conditioner is readily turned on along with the heating units and the room will quickly become warmed to a temperature desired by the occupant or occupants.

Figure 4:
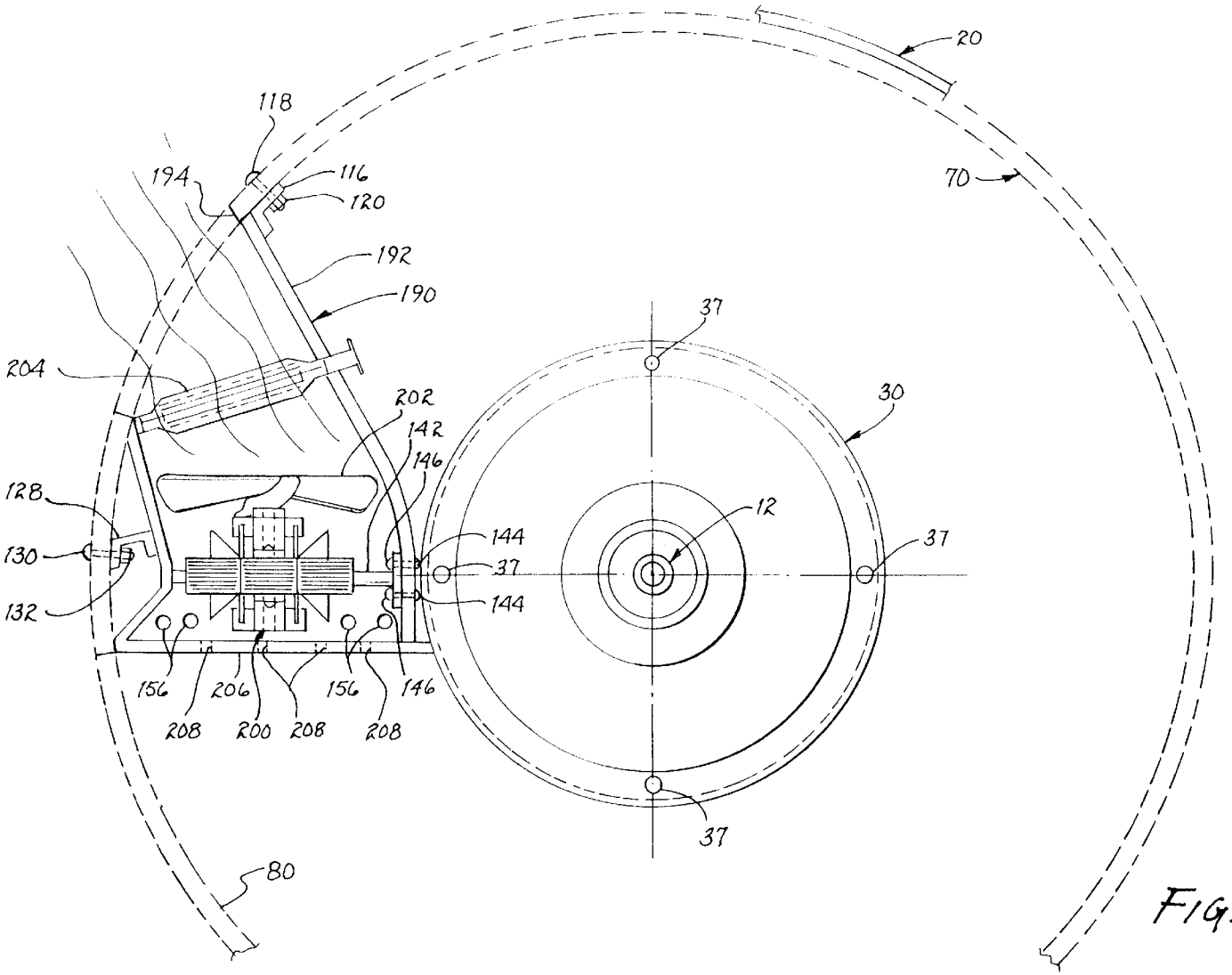
FIG. 4 is a partial cross-sectional view of the intention of the room conditioner, which view looks upwardly into the room conditioner and illustrates a variant of the heating unit.

Referring to FIG. 4, there is shown a variant heating unit 190. This variant includes a duct 192 in communication with outlet 194 through shroud 70 and housing 20. The duct maybe essentially circular in cross-section or of other cross sectional configuration. The duct is secured to shroud 70 through a brace 116 and a brace 128, as described above with respect to heating units 100 and 102. Other means for securing duct 192 are contemplated. An electric motor 200 maybe secured within duct 192 through a mounting 142 (as described above). Other mounting means well known to those skilled in the out may also be employed. The shaft of motor 200 supports a fan 202 for a exhausting the air through outlet 194. A heating unit 204 is located downstream of fan 202 and within duct 192. The duct may include a plurality of inlets 156 (as described above) upstream of fan 202 to provide a source of inflowing air to be heated. Such inlets are contemplated in the event the upstream end of the duct is closed. In the event the upstream end of the duct is open, there is no need for inlets 156 as fan 202 would draw air into the duct through the upstream open end of the duct. Alternatively, if the upstream end of the duct includes a wall 206, such wall may be appertured by a plurality of appertures 208 to permit an inflow of air therethrough.

In operation, upon actuation of motor 200, fan 202 will be caused to rotate to establish an air flow through heating unit 204 and through outlet 194. Upon energization of heating element 204, the air flowing there past and there through would be heated. The resulting heated air exhausting through outlet 194 will mix with the vertical air flow caused by set of blades 36 (see FIG. 1). Thereby, the exhausted heated air would become dispersed in a relatively uniform manner throughout the room wherein room conditioner 10 is located.

It may be noted that two or more variant heating units 190 may be disposed within shroud 70 to exhaust heated air through corresponding outlets in the shroud and attendant housing 20. For example, a pair of variant heating units 190 may be located in their diametrically opposed locations within shroud 70 to exhaust heated air in a essentially opposed directions to aid in uniform dispersement of the heated air into the airflow caused by set of blades 36. Moreover, two pairs of variant heating units 190 may be used. Other variations of location and configuration of the heating units, whether single fan or dual fan operated, may be utilized.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

I claim:

1. A room conditioner for heating a room having a ceiling, walls and a floor, said room conditioner comprising in combination:

a) at least one support, adapted to an upward location;

b) at least one distribution motor having at least one fan blade adapted to said at least one distribution motor for generating an upward flow of air;

c) at least one independent heating unit isolated from said distribution motor, said at least one independent heating unit comprised of:

1. at least one heating element;
2. at least one secondary motor, said at least one secondary motor being independent from said distribution motor; and
3. at least one secondary fan blade adapted to said secondary motor for urging a flow of air past said at least one heating element for mixing with said upward flow of air thereby resulting in near uniform distribution mixed heated airflow throughout the room.

2. The room conditioner as set forth in claim 1 wherein said at least one independent heating unit further comprises at least one outlet.

3. The room conditioner as set forth in claim 1 wherein said at least one independent heating unit further comprises a plurality of heating elements, a plurality of outlets, a plurality of independent motors having at least one adapted fan blade for urging air past said plurality of heating elements.

4. The room conditioner as set forth in claim 3 further comprising a plurality of outlets for airflow generated by said plurality of said independent motors, wherein said upward flow of air impacts and flows across the ceiling of the room, then down and across the walls, then across the floor then back into said upward flow air.

5. The room conditioner as set forth in claim 1 wherein said at least one independent heating unit comprises a plurality of heating elements.

6. The room conditioner as set forth in claim 1 further comprising a heat barrier for reducing transfer of heat between said at least one heating element and said at least one distribution motor and said at least one additional independent motor.

7. The room conditioner as set forth in claim 1 wherein said at least one independent heating unit comprises a plurality of independent heating units.

8. The room conditioner as set forth in claim 7 wherein each room conditioner is composed of the following components: at least one support; at least one motor; at least one fan blade; at least one secondary motor; at least one secondary fan blade; at least one heating element; at least one outlet and at least one inlet.

9. The room conditioner as set forth in claim 7 further comprising a heat sink material that protects said at least one distribution motor and said at least one secondary motor from adverse heat.

10. A room conditioner for heating a room having a ceiling, a floor and walls, said room conditioner comprising in combination the following components:

a) at least one support;

b) at least one distribution motor for rotating at least one fan blade to produce a upward airflow;

c) a heat barrier material protecting said at least one distribution motor from adverse heat; and d) at least one heating unit; comprising at least one independent motor, at least one fan blade operated by said at least one independent motor for creating and urging a secondary airflow over at least one heating element, wherein said secondary airflow mixes with said upward airflow.

11. The room conditioner as set forth in claim 10 including at least one outlet for exhausting said heated secondary airflow into the path of said upward airflow directed first toward the ceiling.

12. The room conditioner as set forth in claim 11 having multiple outlets for distributing secondary heated airflow into the path of said upward airflow.

13. The room conditioner as set forth in claim 12 including at least one inlet for introducing air to said independent heating unit.

14. The room conditioner as set forth in claim 10 wherein said at least one heating unit comprises more than one heating unit.

15. The room conditioner as set forth in claim 10 including at least one housing and heat sink material for protecting said at least one distribution motor and said at least one secondary motor from adverse heat.

16. The room conditioner as set forth in claim 10 including at least one inlet for introducing air to be heated.

17. A room conditioner for heating a room, said room conditioner comprising in combination:

a) at least one motor and at least one fan blade for creating optionally an upward first airflow for heating or a downward first airflow for cooling;

b) at least one support for supporting said at least one motor;

c) at least one heating unit for discharging a second airflow of heated air into the path of the first upward airflow;

d) a means for optionally selecting either an upward or downward airflow; and e) a heat sink material protecting at least one component from adverse heat.

18. The room conditioner as set forth in claim 17 wherein said at least one heating unit includes at least one outlet for discharging the second airflow.

19. The room conditioner as set forth in claim 18 wherein said at least one outlet directs a heated secondary airflow generated by at least one fan blade for generating the second airflow, a further at least one motor for rotating said at least one fan and at least one heating element for heating the second airflow.

20. The room conditioner as set forth in claim 19 including at least one inlet for inflow of air to be heated.

21. The room conditioner as set forth in claim 20 including a further outlet for discharging the second airflow.

22. The room conditioner as set forth in claim 21 wherein said at least one heating unit comprises more than one heating units, each of said at least one heating units being adapted to discharge the second airflow through at least one outlet.

23. The room conditioner as set forth in claim 22 wherein each at least one heating unit of said more than one heating units includes at least one of said outlets disposed for discharging the second air flows.

24. The room conditioner as set forth in claim 23 includes a further motor for rotating further fan blades for urging further air flows in multiple directions and at least one heating element disposed in the path of each air flow to heat the air flowing therepast.

25. A method for heating a room with a room conditioner, said method comprising the steps of:

a) producing a first upward airflow with at least one fan blade adapted to at least one distribution motor for distribution throughout a room;

b) generating a second independent airflow with at least one additional fan blade adapted to at least one independent second motor housed independently of said distribution motor for mixing with the first airflow;

c) heating the second airflow with at least one heating element housed independently of said distribution motor prior to exhausting the heated secondary airflow through at least one outlet into the path of the first upward airflow; and d) mixing said first upward airflow with said heated secondary airflow for near uniform distribution of mixed heated airflow throughout a room.

26. The method as set forth in claim 25 wherein said step of producing is carried out by the at least one fan blade and a further fan blade for directing air in multiple directions, a further heating element to heat the air directed in each direction, through at least one outlet and a further outlet.

27. The method as set forth in claim 25 including the step of further generating additional at least one airflow with a further fan blade with a further heating unit for discharge through a further outlet to mix with the first upward airflow and the step of further heating the additional at least one airflow with a further heating element prior to mixing with the first upward airflow to elevate the temperature of the first upward airflow.

28. The method as set forth in claim 27 wherein said step of further generating includes the step of further producing the additional at least one airflow created by a further motor for rotating the further fan, the further heating element and the further outlet.

29. A room conditioner for heating a room, said room conditioner comprising in combination the following components:

a) at least one support depending from an upward location;

b) at least one distribution motor;

c) at least one primary fan blade rotatably operative upon energization of said at least one distribution motor to generate a primary upward flow of air for heating or a primary downward flow of air for cooling;

d) at least one independently housed heating unit isolated from said distribution motor including at least one heating element for heating air flowing therepast; and at least one secondary fan blade adapted to at least one independent motor associated with said at least one independent heating unit for urging a secondary flow of air past said at least one heating element before exhausting the heated secondary airflow through at least one independent heating outlet into the path of the said primary upward flow of air for distribution throughout a room, office or the like.

30. The room conditioner as set forth in claim 29 wherein said at least one independent heating unit includes at least one inlet for channeling air to said at least one heating element in response to operation of said at least one secondary fan blade.

31. A method for heating a room having a ceiling, a floor and walls with a room conditioner, said method comprising the steps of:

a) producing a first upward airflow for distribution throughout a room, with at least one fan blade adapted to a distribution motor depending from at least one support;

b) generating a second airflow from an independent heating unit that comprises an independent second motor with at least one secondary fan blade for mixing with the first airflow;

c) heating the second airflow with at least one heating element prior to mixing with the first upward airflow to elevate the temperature of the first airflow prior to near uniform distribution throughout a room; and d) said step of generating including the step of producing the second airflow with at least one independent heating unit motor for rotating the at least one fan blade into the path of the first upward airflow and at least one outlet for discharging the second airflow into the path of the first upward airflow.

32. The method as set forth in claim 31 wherein said step of near uniform distribution follows a path that first impacts and flows across the ceiling, then the walls, then the floor and repeats said method as described.

33. The method as set forth in claim 31 including the step of further generating subsequent at least one airflow with a further fan blade for discharge through a further outlet to mix with the first upward airflow and the step of further heating the subsequent at least one airflow with a further heating element prior to mixing with the first upward airflow to elevate the temperature of the first upward airflow.

34. The method as set forth in claim 33 wherein said step of generating and wherein said step of further generating includes the step of further producing the subsequent at least one airflow with a further motor for rotating the further fan, the further heating element and the further outlet.

35. A room conditioner for heating a room, said room conditioner comprising in combination:

a) an air distribution device having at least one distribution motor and at least one adapted fan blade for creating a first upward airflow for near uniform circulation that first impacts the ceiling;

b) at least one support for supporting said air distribution device;

c) at least one independent heating unit for discharging a second airflow of heated air, created by at least a second independent heating unit motor adapted to at least a second fan blade, wherein said fan blade urges said second airflow through at least one heating element for heating, then through at least one outlet into the path of said first upward airflow; and d) a housing for enclosing said at least one independent heating unit.

36. A method for heating a room with a room conditioner, said method comprising the steps of:

a) producing a first upward airflow with at least one fan blade adapted to a first distribution motor supported from at least one support between the ceiling and the floor;

b) generating a second heated airflow with at least one fan blade adapted to a second independent motor;

c) heating the second airflow with at least one heating element, isolated to protect motorized components from destructive heat, prior to exhausting resultant heated airflow through at least one outlet; and d) mixing the heated second airflow with said first upward airflow for the purpose of heating said first upward airflow.

37. The method as set forth in claim 36 wherein said step of generating is carried out by a plurality of fan blades each adapted to one each of a plurality of independent motors for directing air in multiple directions, a plurality of heating elements adapted to heat the air directed in the multiple directions, respectively, said step of discharging including the step of discharging the heated air through at least one outlet.

38. The method as set forth in claim 36 including the step of further generating subsequent at least one heated secondary airflow with a further at least one fan blade for discharge through a further outlet to mix with the first upward airflow and the step of further heating the subsequent at least one airflow with a further heating element prior to mixing with the first upward airflow to elevate the temperature of the first upward airflow.

39. The method as set forth in claim 38 wherein said step of further generating includes the step of further producing the subsequent at least one heated secondary airflow with a plurality of independent motors.

40. A method for heating a room with a room conditioner, said method comprising the steps of:

a) producing a first upward airflow with at least one fan blade of an air distribution device extending from a first motor depending from a support;

b) generating a second airflow with at least one fan blade adapted to cooperate with a independent heating unit for mixing with the first upward airflow;

c) heating the second airflow with at least one heating element prior to mixing with the first upward airflow to elevate the temperature of the first upward airflow; and d) said step of generating including the step of producing the second airflow with a second motor remotely housed from said first motor, for rotating said at least one fan blade and for directing the second airflow through at least one outlet into the path of the first upward airflow for distribution in a near uniform manner throughout a room.

41. The method as set forth in claim 40 further comprising the step of generating a plurality of secondary heated airflows with a plurality of fan blades for discharge through a plurality of outlets to mix with the first upward airflow and the step of further heating the plurality of secondary heated airflows with a further heating element prior to mixing with the first upward airflow to further elevate the temperature of the first upward airflow.

42. The method as set forth in claim 41 wherein said step of further generating includes the step of further producing the plurality of secondary heated airflows with at least one additional independent motor for rotating the further fan blade.

43. A room conditioner for heating a room having a ceiling, a floor and walls, said room conditioner comprising in combination the following components:

a) at least one support dependingly supported from an upward location;

b) at least one distribution motor;

c) at least one fan blade adapted to extend from said distribution motor for generating an upward airflow;

d) at least one isolated heating unit including at least one heating element for heating air flowing therepast, and including at least one outlet;

e) at least one inlet for introducing air to be heated to said at least one independent heating unit; and f) at least one fan blade adapted to at least one independent additional motor for urging a flow of air past said at least one heating element and through said at least one outlet for mixing with and heating said upward airflow.

44. The room conditioner as set forth in claim 43 wherein said at least one independent heating unit includes more than one of said at least one outlet.

45. The room conditioner as set forth in claim 43 wherein each of said at least one independent heating units includes at least one heating element, at least one further outlet, at least one independent additional motor for rotating said at least one fan blade for urging a flow of air past said at least one further heating element and through said at least one further outlet.

46. The room conditioner as set forth in claim 45 including at least one outlet and said at least one further outlet.

47. The room conditioner as set forth in claim 43 including at least one further independent heating unit.

48. The room conditioner as set forth in claim 43 including a heat sink material for protecting motorized components from adverse heat.

49. The room conditioner as set forth in claim 43 wherein said at least one independent heating unit comprises additional independent heating units.

50. The room conditioner as set forth in claim 49 wherein each of said at least one independently isolated heating unit includes at least one heating element, at least one outlet, at least one independent additional motor for rotating at least one fan blade, at least on inlet for introducing air to be heated and at least one outlet for exhausting heated secondary airflow into the path of upward primary airflow for mixing and circulating throughout the room.

51. The room conditioner as set forth in claim 50 including a heat sink material protecting at least one motorized component from adverse heat.

52. A room conditioner for heating a room, said room conditioner comprising in combination the following components:

a) at least one support;

b) at least one primary distribution motor for rotating at least one fan blade to produce, while in operation, a continuous circular airflow that flows first upwardly;

c) at least one independent heating unit having at least one inlet for introducing air to be heated and at least one outlet for exhausting heated airflow;

d) each of said at least one independent heating units including at least one independent additional motor and at least one fan blade operated by said at least one independent additional motor for urging airflow through at least one heating element to create a heated airflow, then through said at least one outlet for mixing with said continuous circulating airflow to raise the temperature of said continuous circulating airflow, to achieve near uniform heated temperatures in a room, office or the like; and e) a heat sink material for protecting at least one motorized component from the conductive transfer of heat created by said at least one heating element.

53. The room conditioner as set forth in claim 52 including a further independent heating unit with at least one outlet and said at least one independent additional motor, said at least one adapted fan blade and said at least one heating element.

54. The room conditioner as set forth in claim 52 wherein additional fan blades adapted to independent additional motors urges airflow in multiple directions, past additional heating elements for heating the flow of air in multiple directions, and additional outlets exhausting the heated flows of air for mixing with said continuous circulating airflow.

55. The room conditioner as set forth in claim 54 including at least one inlet for introducing air to be heated.

56. The room conditioner as set forth in claim 52 wherein each of said at least one independent heating unit is isolated from motorized components through the use of a heat sink material.

57. The room conditioner as set forth in claim 52 including at least one housing to cover at least one component part.

58. The room conditioner as set forth in claim 52 including at least one inlet for introducing air to be heated.

59. A room conditioner for heating a room, said room conditioner comprising in combination:

a) an air distribution device having at least one motor and at least one adapted fan blade for creating an upward distributive airflow;

b) at least one means of support for adapting said air distribution device to an upward location; and c) at least one independent heating unit, isolated from said air distribution device for providing a heated airflow, comprising in combination:

1. at least one additional motor with at least one adapted fan blade for creating a secondary airflow;
2. at least one heating element for heating said secondary airflow;
3. at least one outlet for exhausting resultant heated secondary airflow into the path of upward distributive airflow for mixing;
4. a heat sink material protecting motorized components from the transfer of heat created by said at least one heating element.

60. The room conditioner as set forth in claim 59 wherein said each of said at least one independent heating units includes at least one inlet for introducing air to be heated.

61. The room conditioner as set forth in claim 60 wherein each of said at least one independent heating units depends on at least one fan blade for generating the second airflow, and a further motor for rotating said at least one fan blade and at least one heating element for heating the second airflow, wherein the heated second airflow is distributed first against and across the ceiling, then down the walls, then across the floor, then again reheated by said heated second airflow in additional cycles of distribution.

62. The room conditioner as set forth in claim 61 including at least one inlet for inflow of air to be heated.

63. The room conditioner as set forth in claim 62 including at least one outlet for discharging said heated second airflow.

64. The room conditioner as set forth in claim 59 wherein each of said at least one independent heating units is adapted to discharge said heated second airflow, created by said additional motor, said adapted fan blade and said at least one heating element, through at least one outlet.

65. The room conditioner as set forth in claim 64 wherein each of said at least one independent heating units introduces said heated second airflow through at least one inlet prior to heating.

66. The room conditioner as set forth in claim 65 wherein each of said at least one outlets depends on at least one motor for rotating more than one fan blade for urging disposed in the path of each of air flow in multiple directions and one of said at least one heating elements being disposed in the path of each air flow to heat the air flowing therepast.

67. A method for heating a room with a room conditioner, said method comprising the steps of:

a) producing a primary circulative airflow with at least one fan blade of an air distribution device adapted to a low speed primary motor supported from at least one support, wherein said step of producing circulates the primary circulative airflow first upwardly against then across the ceiling, then down and across the walls, then laterally across the floor, then again upwardly into additional circulation;

b) generating a second airflow with a further at least one fan blade of an independent heating unit adapted to a higher speed secondary motor;

c) heating the second airflow with at least one heating element and said at least one independent heating units prior to mixing with the primary circulative airflow to elevate the temperature of the primary circulative airflow; and d) using heated primary circulative airflow to achieve near uniform temperatures in a room, office or the like.

68. The method as set forth in claim 67 wherein said step of producing is carried out by at least one further fan blade adapted to at least one further higher speed motor for directing air in multiple directions with at least one further heating element to heat the air directed in each direction through at least one outlet and at least one further outlet.

69. The method as set forth in claim 67 including the step of further generating subsequent at least one second airflow with at least one further fan blade and higher speed motor combination, at least one further heating element, at least one further inlet for introducing air to be heated and at least one further outlet, said components comprising a further independent heating unit for further heating the subsequent at least one further second airflow prior to mixing with the primary circulative airflow to elevate the temperature of the primary circulative airflow.

70. The method as set forth in claim 69 wherein said step of further generating includes the step of further producing the heated second airflow upwards of the primary circulative airflow to ensure the immediate mixing of subsequent heated airflow with the primary circulative airflow to further elevate the temperature of the primary circulative airflow.

71. A room conditioner for heating a room, said room conditioner comprising in combination:

a) at least one support depending from an upward location;

b) an air distribution unit comprising at least one distribution motor having a heat sink cover for protection of motorized components from transferred heat;

c) at least one fan blade rotatably operative upon energization of said motor to generate a primary airflow that flows first upwardly against and across the ceiling;

d) at least one housing for enclosing at least one component;

e) at least one independent heating unit isolated from said at least one distribution motor and at least one fan blade, comprising in combination;

1. at least one fan blade adapted to at least one additional motor for creating a secondary airflow;
2. at least one inlet for introducing air to be heated;
3. at least on heating element for raising the temperature of said secondary airflow; and
4. at least one outlet for exhausting the heated secondary airflow into the path of said primary airflow, for the purpose of elevating the temperature of said primary airflow, isolated from said distribution unit by location and heat sink material for the purpose of protecting said distribution motor from the transfer of damaging heat created by said at least one heating element.

72. The room conditioner as set forth in claim 71 wherein said room conditioner circulates said heated primary airflow upwardly then across the ceiling, down the walls, laterally across the floor and again upwardly to continue the cycle of heating said primary upward airflow to raise the temperature of a room.

73. A method for heating a room with a room conditioner, said method comprising the steps of:

a) producing a first upward airflow with at least one blade adapted to a primary distribution motor having at least one support;

b) generating an independent second airflow with a further fan blade adapted to a secondary motor isolated from said primary distribution motor for mixing with said first upward airflow;

c) heating the independent second airflow with at least one heating element prior to mixing with the first upward airflow to elevate the temperature of the first upward airflow; and d) producing a near uniform temperature within a room by circulating the heated first upward airflow throughout the room first against and across the ceiling, the down the walls, then across the floor and then upwards back into circulation.

74. The method as set forth in claim 73 wherein at least one inlet provides air to be heated and at least on outlet exhausts the heated independent second airflow.

75. The method as set forth in claim 73 including the step of further generating a subsequent at least one heated independent secondary airflow with a further fan blade adapted to a further secondary motor for creating an airflow to be heated by a further heating element for discharge through at least one further outlet for mixing with said upward airflow to further elevate the temperature of said upward airflow to more rapidly achieve a near uniform temperature in a room, office or the like.

76. A room conditioner for uniformly heating a room, said room conditioner comprising in combination:

a) a shaft dependingly supported from an upward location;

b) a casing rotatably mounted on said shaft for enclosing a motor having a rotor secured to said casing;

c) a set of fan blades extending from said casing;

d) a housing for enclosing said casing, said housing being supported by said shaft;

e) at least one heating unit including a heating element for heating air flowing therepast, said heating unit being disposed within said housing and said heating unit including a further heating element, a further outlet, a motor for rotating said fan and a further fan for urging a flow of air past said further heating element and through said further outlet and at least one outlet coincident with said housing; and f) a fan disposed within said heating unit for urging a flow of air past said heating element and through said outlet for mixing with a flow of air generated by said set of blades.

77. The room conditioner as set forth in claim 76 including a duct extending between said outlet and said further outlet for containing said motor, said fan, said further fan, said heating element and said further heating element.

78. A room conditioner for uniformly heating a room, said room conditioner comprising in combination:

a) a shaft dependingly supported from an upward location;

b) a casing rotatably mounted on said shaft for enclosing a motor having a rotor secured to said casing;

c) a set of fan blades extending from said casing;

d) a housing for enclosing said casing, said housing being supported by said shaft;

e) at least a pair of heating units disposed within said housing in opposed relationship, each of said heating units including a heating element for heating air flowing therepast and including at least an outlet coincident with said housing; and f) a fan disposed within said heating unit for urging a flow of air past said heating element and through said outlet for mixing with a flow of air generated by said set of blades.

79. A room conditioner for uniformly heating a room, said room conditioner comprising in combination:

a) a shaft dependingly supported from an upward location;

b) a casing rotatably mounted on said shaft for enclosing a motor having a rotor secured to said casing;

c) a set of fan blades extending from said casing;

d) a housing for enclosing said casing, said housing being supported by said shaft;

e) at least a pair of heating units, each said heating unit including a heating element for heating air flowing therepast, said pair of heating units being disposed within said housing and including at least an outlet coincident with said housing; and f) a fan disposed within said heating unit for urging a flow of air past said heating element and through said outlet for mixing with a flow of air generated by said set of blades.

80. The room conditioner as set forth in claim 79 wherein each heating unit of said pair of heating units includes a duct disposed between two outlets in said housing, a motor disposed in said duct for operating a pair of fans for urging air through said outlets and a pair of heating elements for heating the air flowing through each of said outlets.

81. The room conditioner as set forth in claim 80 including a shroud disposed within said housing and brace means for securing each heating unit of said pair of heating units to said shroud.

82. A room conditioner for uniformly heating a room, said room conditioner comprising in combination:

a) a shaft;

b) a motor secured to said shaft, said motor having a rotor for rotating a set of blades to produce a vertical airflow;

c) a shroud supported by said shaft;

d) a heating unit disposed within said shroud and having at least one outlet disposed in said shroud;

e) said heating unit including a secondary motor, a fan operated by said secondary motor for urging airflow through said outlet for mixing with the vertical airflow, said fan comprising a pair of fans mounted upon a common shaft of said secondary motor for urging air flow in opposed directions, and a heating element for heating the air flowing through said outlet to raise the temperature of the vertical airflow, said heating element comprising a pair of heating elements for heating the flow of air in each direction, said outlet comprising a pair of outlets for exhausting the heated flows of air for mixing with the vertical airflow; and f) a duct disposed interiorly of said outlet and within said shroud for housing said secondary motor, said fan and said heating element.

83. The room conditioner as set forth in claim 82 including inlets disposed in each of said ducts for introducing air into said ducts.

84. The room conditioner as set forth in claim 82 wherein said a pair of heating units are supported in opposed relationship within said shroud.

85. A room conditioner for uniformly heating a room, said room conditioner comprising in combination:

a) a ceiling fan having a motor and a set of blades for creating a first airflow;

b) a shaft for dependingly supporting said ceiling fan;

c) a heating unit for discharging a second airflow of heated air into the path of the first airflow;

d) a shroud depending from said shaft for supporting said heating unit; and e) said heating unit comprising a pair of heating units, each of said heating units being adapted to discharge the second airflow through outlets in said shroud.

86. The room conditioner as set forth in claim 85 wherein each heating unit of said pair of heating units includes a duct having one of said outlets disposed at each end for discharging the second air flows.

87. The room conditioner as set forth in claim 86 wherein each duct includes a further motor for rotating a pair of fans for urging air flow in opposed directions and a heating element disposed in the path of each air flow to heat the air flowing therepast.

88. A method for uniformly heating a room with a room conditioner, said method comprising the steps of:

a) producing a first vertical airflow with a set of blades of a ceiling fan dependingly supported from a shaft;

b) generating a second airflow with a fan housed within a heating unit for mixing with the first airflow;

c) heating the second airflow with a heating element disposed within the heating unit prior to mixing with the first airflow to elevate the temperature of the first airflow;

d) said step of generating including the step of producing the second airflow within a duct having a motor for rotating the fan, a heating element for carrying out said step of heating and an outlet for discharging the second air flow; and e) said step of producing being carried out by the fan and a further fan disposed on opposed sides of the motor for directing air in opposed directions within the duct and a further heating element disposed within the duct to heat the air directed in each direction and through the outlet and a further outlet.

89. A method for uniformly heating a room with a room conditioner, said method comprising the steps of:

a) producing a first vertical airflow with a set of blades of a ceiling fan dependingly supported from a shaft;

b) generating a second airflow with a fan housed within a heating unit for mixing with the first airflow;

c) heating the second airflow with a heating element disposed within the heating unit prior to mixing with the first airflow to elevate the temperature of the first airflow;

d) said step of generating including the step of producing the second airflow within a duct having a motor for rotating the fan, a heating element for carrying out said step of heating and an outlet for discharging the second air flow;

e) further generating a third airflow with a further fan housed within a further heating unit for discharge through a further outlet to mix with the first airflow; and f) further heating the third airflow with a further heating element disposed within the further heating unit prior to mixing with the first airflow to elevate the temperature of the first airflow.

90. The method as set forth in claim 89 wherein said step of further generating includes the step of further producing the third airflow within a further duct housing a further motor for rotating the further fan, the further heating element and the further outlet.

91. A method for uniformly heating a room with a room conditioner, said method comprising the steps of:

a) producing a first vertical airflow with a set of blades of a ceiling fan depending from a support;

b) generating a second airflow with a fan housed for mixing with the first airflow;

c) heating the second airflow with a heating element disposed within the heating unit prior to mixing with the first airflow to elevate the temperature of the first airflow;

d) said step of generating including the step of producing the second airflow with a motor for rotating the fan into the path of the first airflow and an outlet for discharging the second air flow;

e) further generating a third airflow with a further fan housed for discharge through a further outlet to mix with the first airflow; and f) further heating the third airflow with a further heating element prior to mixing with the first airflow to elevate the temperature of the first airflow.

92. The method as set forth in claim 91 wherein said step of generating is carried out within a duct and wherein said step of further generating includes the step of further producing the third airflow within a further duct housing a further motor for rotating the further fan, the further heating element and the further outlet.

* * * * *